US006283176B1

(12) United States Patent
Wurst et al.

(10) Patent No.: US 6,283,176 B1
(45) Date of Patent: Sep. 4, 2001

(54) DEVICE FOR METERING AND DISPENSING POWDERED FILLING MATERIAL INTO CONTAINERS

(75) Inventors: Reiner Wurst, Auenwald; Juergen Widmaier, Stuttgart; Bruno Kettenbach, Korb, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/541,691

(22) Filed: Apr. 3, 2000

(30) Foreign Application Priority Data

Apr. 3, 1999 (DE) ..... 199 15 259

(51) Int. Cl.[7] ..... B65B 1/04
(52) U.S. Cl. ..... 141/144; 141/67
(58) Field of Search ..... 141/67, 11, 12, 141/70, 71, 81, 86, 93, 121–123, 125, 129, 144, 286, 290; 222/368, 152, 636

(56) References Cited

U.S. PATENT DOCUMENTS 4,671,430 * 6/1987 Dinius ..... 222/135
4,949,766 * 8/1990 Coatsworth ..... 141/67

* cited by examiner

*Primary Examiner*—Steven O. Douglas

(74) *Attorney, Agent, or Firm*—Ronald E. Greigg; Edwin E. Greigg

(57) ABSTRACT

A device for metering and dispensing powdered filling material into containers has two filling wheels, which are disposed one after the other in the feed direction of the containers. At least the filling wheels are comprised of ceramic material and, in comparison to conventional filling wheels, have a reduced number of metering bores as well as a smaller structural size. In order to adjust the metering quantity, the filling wheels each have an adjusting disk, which cooperates with metering plungers. The two filling wheels and the two metering disks are respectively driven by a servomotor. The device according to the invention is distinguished by means of a compact design and an operation that is suitable in the pharmaceutical field.

16 Claims, 3 Drawing Sheets

DEVICE FOR METERING AND DISPENSING POWDERED FILLING MATERIAL INTO CONTAINERS

BACKGROUND OF THE INVENTION

The invention relates to a device for metering and dispensing powdered filling material into containers of the type known from DE 33 28 820 C2. The known device has a metal filling wheel for the powder. The manufacturing costs of a filling wheel of this kind are very high due to the large number of recesses that are required as weight saving measures and due to the desired precision of the bores for the metering pistons. Furthermore, the abrasion resistance of such a filling wheel and its ability to be cleaned or sterilized are critical when it is used in the pharmaceutical field. With the known device, it is also necessary to manually adjust each metering piston individually in its radial position if a different metering quantity is desired. Such an adjustment therefore requires a relatively large amount of time and requires trained personnel.

OBJECTS AND ADVANTAGES OF THE INVENTION

The device according to the invention for metering and dispensing powdered filling material into containers, has the advantage over the prior art that its filling wheel is relatively easy to manufacture, is easy to manipulate due to its light weight, and fulfills high demands with regard to the wear resistance and the ability to be cleaned or sterilized.

Other advantageous embodiments of the device according to the invention are defined in the claims. A particularly compact design and a high-performance of the device can be achieved if a number of filling wheels are disposed one after the other in terms of the feed direction of the containers. In this instance, a reduced number of metering pistons is disposed in each filling wheel in comparison to the use of a single filling wheel so that due to the larger angular intervals between the individual metering pistons, a reduced filling wheel diameter is permitted. If the filling material quantity is also reduced to half the amount when two filling wheels are used, then the filling wheel diameter can be additionally reduced due to the lower metering chamber volume.

A central and synchronous adjustment of the metering volume of the metering pistons can be achieved by means of an adjusting disk which cooperates with all of the metering pistons of a filling wheel simultaneously. In order to permit an automatic adjustment of the metering volume without additional manual interventions or adjustments on the filling wheel, in a preferred embodiment, the provision is made that the adjusting device and the filling wheel are coupled by means of a respective servo drive mechanism. It is therefore possible to operate the two servo drive mechanisms synchronously during normal operation and to drive the two servomotors asynchronously for a short time in order to adjust the metering pistons.

BRIEF DESCRIPTION OF THE DRAWINGS

An exemplary embodiment of the invention is shown in the drawings and will be explained in detail below.

DESCRIPTION OF THE PREFERRED EMBODIMENTS

Figure 1:
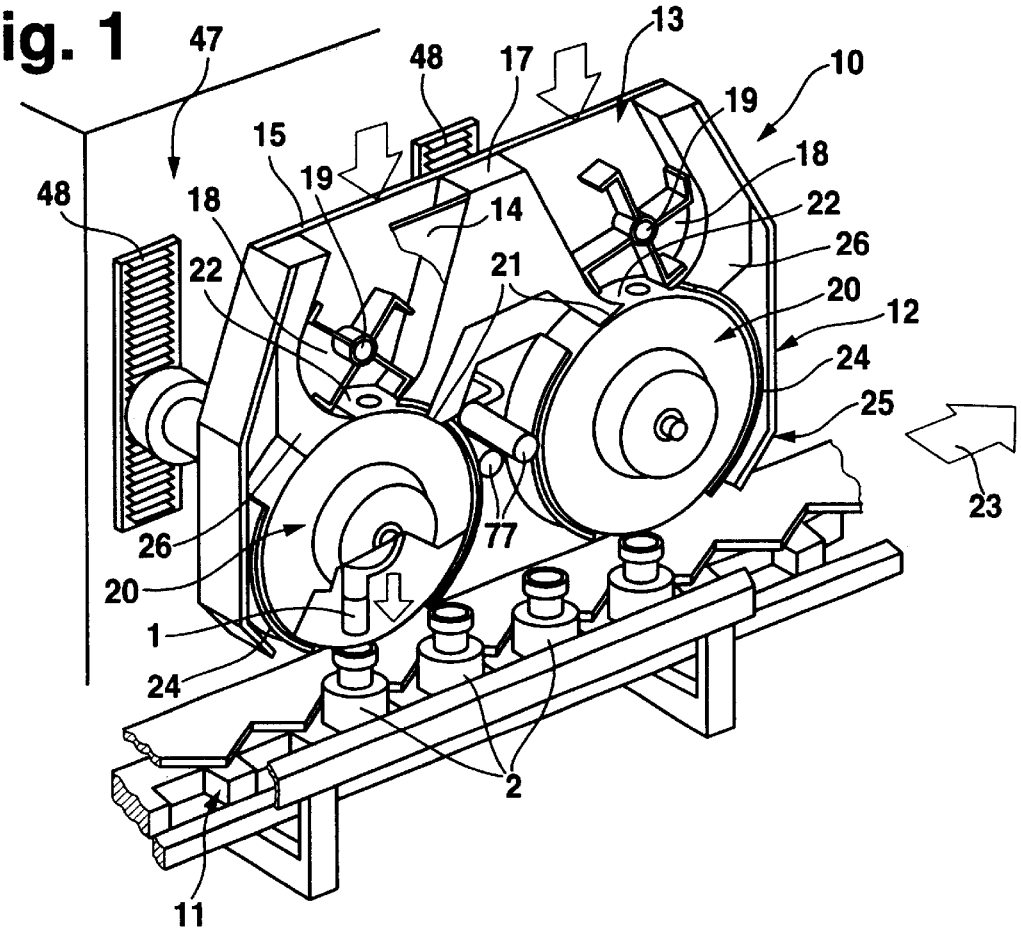
FIG. 1 is a perspective, partially sectional depiction of a part of a device for metering and dispensing a powdered filling material into containers.

The device 10 shown in the figures is used to meter and dispense powder 1 into containers 2 such as bottles, vials, or the like in the field of the pharmaceutical industry. The device 10 has a cyclically driven feed unit 11 for the containers 2, which is not shown in detail and feeds the bottles in spaced relation along under a filling unit 12. The filling unit 12 has a filling chamber 13 for the powder 1 and this chamber is defined by a front and rear filling chamber wall 14, 15. Above the filling chamber 12 there is a larger storage container for the powder 1, which storage container is not shown because it is not essential to the invention. A so-called filling nodule 17 is inserted into the filling chamber 12 and forms two powder supply chambers 18 that are disposed symmetrically to each other. A star-shaped agitator 19 is supported so that it can rotate in each powder supply chamber 18 and assures the supply of powder 1 to filling wheels 20 disposed underneath the agitators 19, which is why the filling nodule 17 has a respective recess 22 in the vicinity of the filling wheels 20.

The two filling wheels 20, which will be described in more detail below, are disposed one after the other in terms of the feed direction of the containers 2, which is indicated with the arrow 23, wherein their spacing corresponds to an integral dividing distance of the containers 2 in the feed unit 11. The filling wheels 20 are each encompassed in a form-fitting manner by a respective multi-part protective plate 24 and these plates are fastened inside the filling chamber housing 25. Between the protective plates 24 and the filling chamber 13, a doctor blade 26 is disposed on the outside of the filling nodule 17 and a spring-loaded sealing clamp 21 is disposed on the opposite side in relation to the agitator 19. The doctor blades 26, which are made of plastic or ceramic, rest against the circumference surface of the filling wheels 20 in order to strip away powder 1 protruding beyond the circumferential surface. In order to prevent falling powder 1 from contaminating the device 10, the inner chamber of the filling chamber housing 25 is also equipped with a suction device that is not shown.

Figure 3:
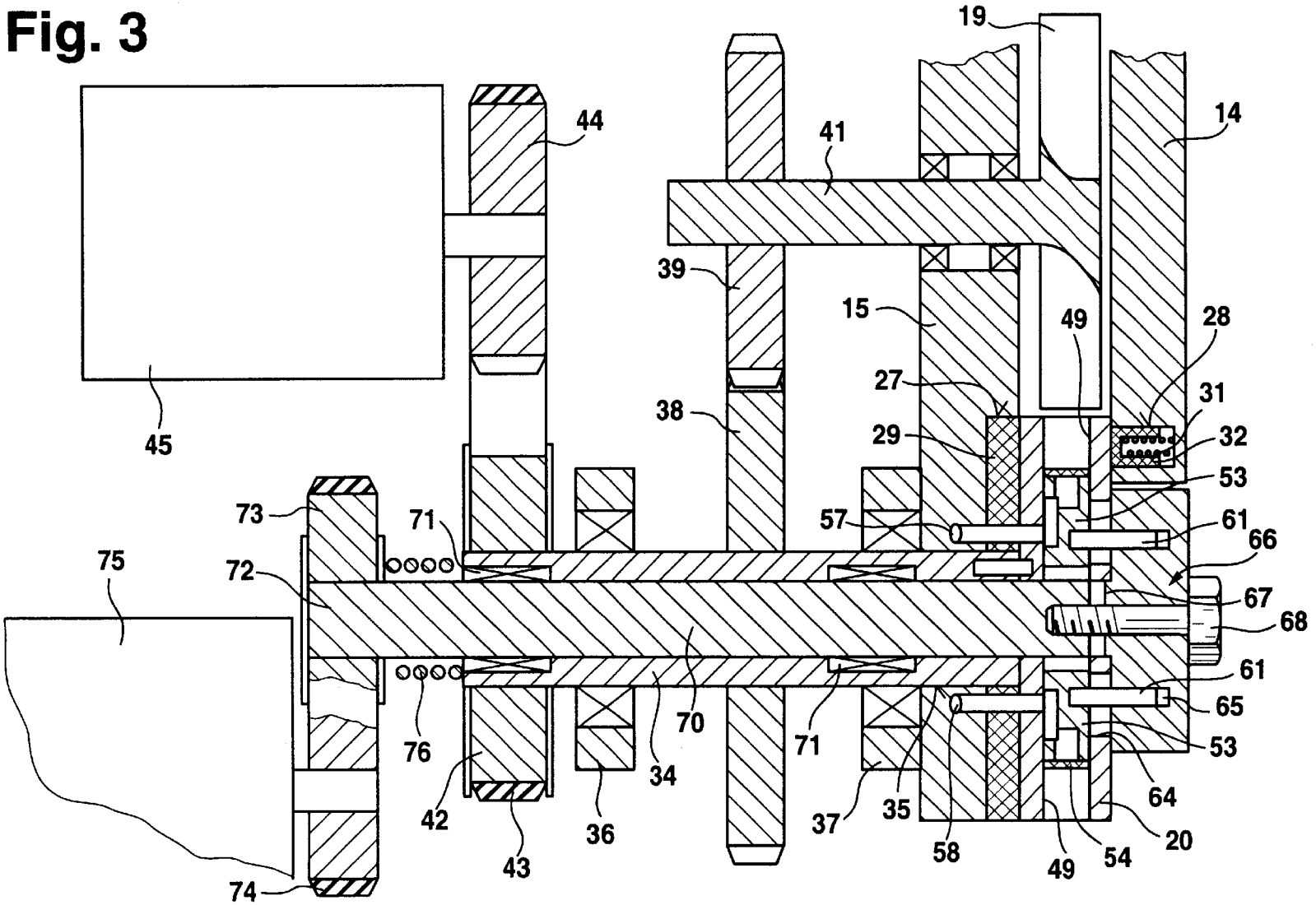
FIG. 3 is a simplified section in the plane III—III in FIG. 2.

As can be seen from FIG. 3, in its upper region, the filling wheel 20 is disposed between the two filling chamber walls 14, 15. In order to permit a seal between the two filling chamber walls 14, 15 and the filling wheel 20, the two filling chamber walls 14, 15 each have a recess 27, 28 disposed on the side oriented toward the filling wheel 20 into which is inserted an annular disk-shaped sealing plate 29 made of ceramic material or a cup-shaped ceramic seal 32 that is acted on with spring force by a spring 31. The filling wheel 20 is fastened in a rotationally fixed manner to a first drive shaft 34, which is embodied as a hollow shaft and passes through the one filling chamber wall 14 in a bore 35. The drive shaft 34 is supported in two bearings 36, 37. Between the two bearings 36, 37, a first gear 38 is fastened to the first drive shaft 34 in a rotationally fixed manner and engages with a second gear 39. The second gear 39 in turn is coupled to the agitator 19 by means of a shaft 41 which passes through the one filling chamber wall 15. A first toothed belt gear 42 is disposed on the end of the drive shaft 34 opposite from the filling wheel 20. The two first toothed belt gears 42 disposed on the drive shafts 34 of the filling wheels 20 have a first toothed belt 43 wound jointly around them and this belt is coupled to a first servomotor 45 by means of another toothed belt gear 44. As a result of the first servomotor 45 being coupled to the two filling wheels 20, these filling wheels are moved synchronously by the first servomotor 45.

The drive elements of the filling unit 12 disposed on the back side of the device 10 are preferably accommodated in a common machine housing 47 (FIG. 1) and can be height-adjusted as a unit in order to adapt to different container sizes, for which purpose openings with sealing collars 48 are embodied in the machine housing 47. In addition, it should be emphasized that this embodiment can only be seen in FIG. 1, while the functional disposition and embodiment of the drive elements of the device 10 are shown in FIG. 3.

The two filling wheels 20 are respectively comprised of ceramic material and have four metering bores 49 disposed offset from one another by 90°. Metering plungers 53 are disposed in the metering bores 49, which extend from the circumferential surface 51 of the filling wheels 20 to a central recess 52. The metering plungers 53, which are comprised of stainless steel, have a screen 54 at their upper end. They have a central suction bore 55, which feeds into a lateral recess 56. The lateral recess 56 cooperates with a suction conduit 57 or an ejection conduit 58, which is embodied in the one filling chamber wall 15 and the sealing plate 29, and is connected to a negative pressure source or overpressure source that is not shown. Whereas the suction conduit 57 in the filling chamber wall 15 is comprised of an arc-shaped slot which covers an angular range of approximately 180° from the upper metering position until just before the transfer position aligned with the container 2, the ejection conduit 58 is only embodied in the filling chamber wall 15 and in the sealing plate 29 in the vicinity of the transfer position.

Figure 4:
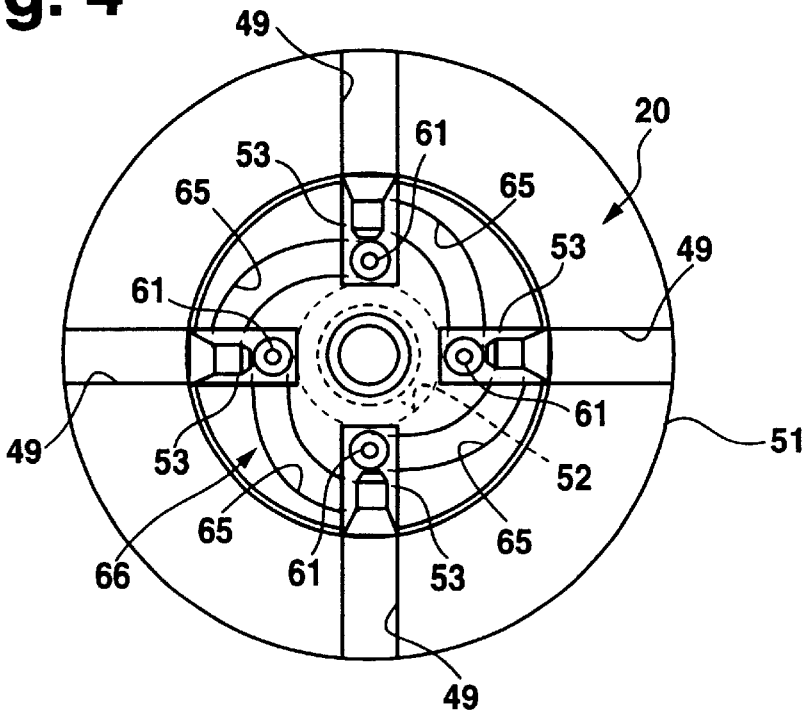
FIG. 4 is a front view of a filling wheel.
Figure 5:
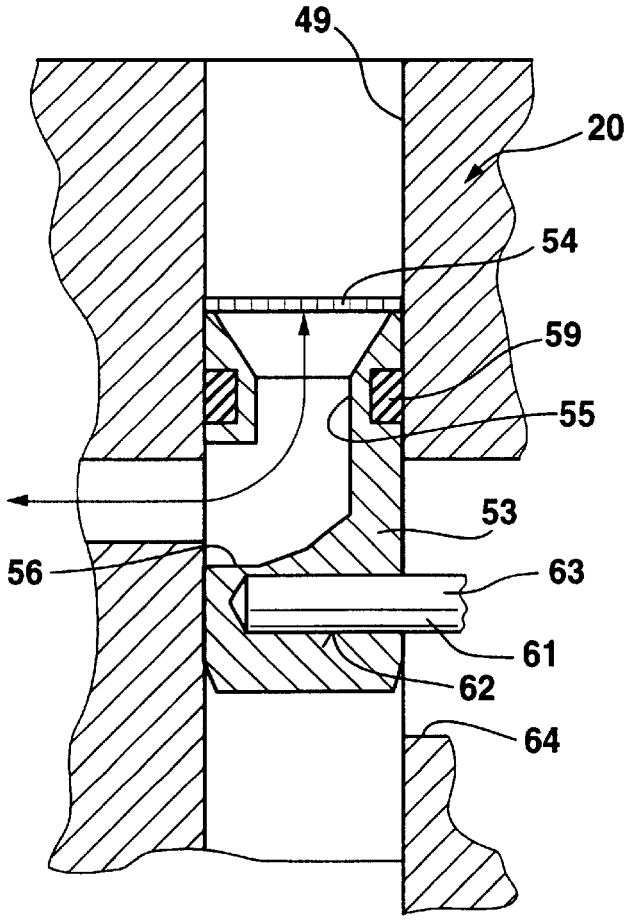
FIG. 5 is a detail of the filling wheel according to FIG. 4, in a sectional view.

The metering plungers 53 (FIG. 5) are supported so that they can slide in the metering bores 49 in order to adapt to different quantities of filling material, wherein a seal 59 is inserted into a corresponding recess of the metering plungers 53, which seals the metering plunger 53 in relation to the metering bore 49. The sizes of the lateral recess 56 and the suction conduit 57 or the ejection conduit 58 are adapted to the adjustment range of the metering plungers 53 so that even in the two extreme positions of the metering plungers 53, a sufficiently great overlap is assured. The adjustment of the metering plungers 53 takes place by means of adjusting pins 61, which are preferably comprised of ceramic and engage in a lateral bore 62 embodied in the lower region of the metering plungers 53. The central regions 63 of the adjusting pins 61 are disposed inside recesses 64 of the filling wheels 20, while the ends of the adjusting pins 61 protruding from the filling wheels 20 protrude into sliding tracks 65 of an adjusting disk 66. As can be seen best in FIG. 4, the sliding tracks 65 are respectively embodied as arc-shaped and are disposed offset from one another. It is essential that the distance of the sliding tracks 65 from the recess 52 respectively changes along the sliding tracks 65 so that in the event of a rotation of the adjusting disk 66 in relation to the filling wheel 20, all of the adjusting pins 61 guided in the sliding tracks 65 are moved the same amount radially inward or outward, as a result of which the adjustment of the metering plungers 53 in the metering bores 49 can be simultaneously changed in order to adjust the metering volumes in the desired manner.

On the side oriented toward the filling wheel 20, the adjusting disk 66 has a shoulder 67, which protrudes into the recess 52 of the filling wheel 20 and is supported so that it can rotate in this recess. The adjusting disk 66 is connected in a rotationally secured fashion to a second drive shaft 70 by means of a screw 68 and this drive shaft 70 is supported in two bearings 71 inside the first drive shaft 34 and on the side opposite from the filling wheel 20, protrudes from the first drive shaft 34 with a shaft stub 72. A second toothed belt gear 73 is fastened to the shaft stub 72 and is coupled to a second servomotor 75 by means of a second toothed belt 74 that is common to both adjusting disks 66 and has teeth on both sides.

Figure 2:
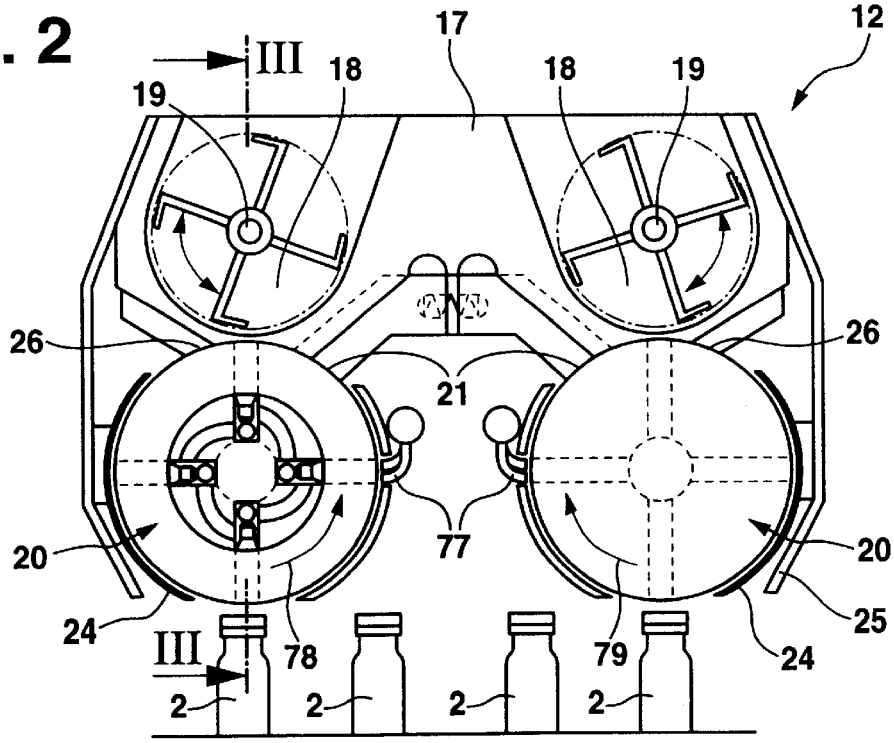
FIG. 2 is a longitudinal section through the device according to FIG. 1.

A compression spring 76 is disposed between the second toothed belt gear 73 and the near end face of the first drive shaft 34 and presses the adjusting disk 66, together with the filling wheel 20, against the sealing plate 29. Finally, the device 10 also has an exhaust nozzle 77 connected to an overpressure source for each filling wheel 20 (FIGS. 1 and 2). In terms of the rotation directions of the filling wheels 20, which are labeled 78 and 79 in FIG. 2, these exhaust nozzles 77 are disposed 90° after the delivery position of the powder 1, which delivery position is aligned with the containers 2.

The above-described device 10 functions as follows: the containers 2 are cyclically fed under the filling wheels 20 by the feed unit 11 and are aligned with these filling wheels. Basically, two operating types of the device 10 must be distinguished from each other below. In the first type of operation, the entire desired filling quantity of powder 1 is introduced into the containers 2 by a single one of the two filling wheels 20. In this instance, the forward feed of the feed unit 11 is such that only every other container 2 comes to a stop under the first filling wheel 20 or under the second filling wheel 20. However, the second type of operation, in which half of the filling material quantity is respectively introduced into each container 2 by each of the two filling wheels 20, is preferable. As a result, on the one hand, the metering volume required in each filling wheel 20 is reduced and on the other hand, the number of metering bores 49 on the filling wheel 20 can be reduced, both of which permit a smaller structural size of the filling wheels 20. In addition, since both filling wheels 20 are driven by a common servomotor 45, the increased cost of the device 10 in comparison to conventional devices is kept within limits since two filling wheels with a smaller diameter replace one filling wheel with a larger diameter.

It is common to both operating types of the device 10 that depending on the position of the metering plungers 53, a predetermined quantity of powder 1 travels into the metering bores 49 when these bores are disposed in the vicinity of the recess 22 of the powder supply chamber 18. This takes place by means of the negative pressure prevailing in the suction bores 55 by means of the suction conduit 57. Powder 1 which protrudes or adheres beyond the circumference surface 51 of the filling wheels 20 is stripped away by means of the doctor blade 26 during the subsequent rotation of the filling wheel 20.

In all movements of the filling wheel 20, it is essential that the two servomotors 45, 75 drive the filling wheel 20 and the adjusting disk 66 cyclically and synchronously so that the positions of the metering plungers 53 in the filling wheel 20 remain unchanged. If the filling wheel 20 is disposed in the transfer position that is offset in relation to the recess 22 by 180°, then the suction bores 55 are disposed in the vicinity of the ejection conduit 58 so that with the aid of compressed air, powder 1 which was previously disposed in the metering bores 49 is ejected into the containers 2. As explained above, the filling wheel 20 is rotated cyclically. In the exemplary embodiment, the filling wheel 20 is respectively rotated by 90° in the rotation direction 78, 79 so that in the stop position that comes 90° after the transfer position, powder 1 possibly still adhering in the metering bore 49 can be blown out of the metering bore 49 by means of the exhaust nozzle 77. This assures that in each metering event, there is no more powder 1 in the metering bores 49, which increases the metering precision and prevents the metering plungers 53 from becoming clogged with powder 1.

If the metering volume in the filling wheels 20 needs to be changed, then this takes place by means of a short, asynchronous operation of the two servomotors 45, 75. The new desired metering quantity is preferably input into the control unit of the device 10 by means of an input unit. Then, during a stop phase of the filling wheels 20, the device temporarily triggers to servo drive mechanism 75 while the other servo drive mechanism 45 remains at rest. As a result, the position of the adjusting disk 66 in relation to the filling wheel 20 changes in the desired manner and consequently, so does the position of the metering pistons 49. Then both servomotors 45, 75 are once again driven in a synchronous fashion.

In a modified embodiment of the invention, which is not shown, a check weigher is disposed between the two filling wheels 20 and is used to determine the filling quantity that is metered in by means of the first filling wheel 20. Furthermore, the two adjusting disks 66 each have a separate drive mechanism. With a device that is modified in this fashion, it is now possible to meter different quantities of filling material by means of the two filling wheels 20. It would thus be conceivable to meter in 90% of the desired filling quantity by means of the first filling wheel 20, while the second filling wheel 20, depending on the result determined by the check weigher, meters in the remaining 10%. In this manner, the metering precision can be increased, wherein simultaneously, by virtue of the fact that the two filling wheels 20 also have a common drive mechanism, the cost is only increased by means of the additional servomotor for the one adjusting disk 66 and by means of the check weigher.

The foregoing relates to a preferred exemplary embodiment of the invention, it being understood that other variants and embodiments thereof are possible within the spirit and scope of the invention, the latter being defined by the appended claims.

We claim:

1. A device (10) for metering and dispensing powdered filling material (1) into containers (2), comprising a cyclically operating transport unit (11) for the containers (2), a storage chamber (18) for the filling material (1), and a plurality of cyclical, horizontally revolving filling wheels (20) disposed one after another in a feed direction (23) of the containers (2), each of said plurality of cyclical, horizontally revolving filling wheels (20) have radially disposed receiving bores (49) for metering pistons (53) which are adjustable in terms of their position in the receiving bores (49) in which a position of the metering pistons (53) can be changed by means of a central adjusting device, said central adjusting device has an adjusting disk (66) that rotates in relation to a drive shaft (34) of the filling wheels (20), and a spiral-shaped guide track (65) for each metering piston (53) is embodied in the adjusting device and is engaged by a guide pin (61) that is connected to the metering piston (53), and the filling wheels are made of one of steel or ceramic material.

2. The device according to claim 1, in which the metering disk (66) is connected to an adjusting shaft (70), which is disposed inside the drive shaft (34) of the filling wheels (20), which drive shaft is embodied as a hollow shaft.

3. The device according to claim 2, in which the drive shaft (34) of the filling wheels (20) and the adjusting disk (66) are respectively coupled to a servo drive mechanism (45, 77).

4. The device according to claim 3, in which the filling wheels (20) cooperate with one of a plastic or ceramic stripping body (26) for protruding filling material (1).

5. The device according to claim 2, in which the metering pistons (53) are comprised of one of stainless steel with a screen (54) or of air-permeable ceramic.

6. The device according to claim 1, in which the drive shaft (34) of the filling wheels (20) and the adjusting disk (66) are respectively coupled to a servo drive mechanism (45, 77).

7. The device according to claim 6, in which the filling wheels (20) and the adjusting disks (66) are jointly driven by a single servo drive mechanism (45, 77), which is respectively coupled to the filling wheels (20) and the adjusting disks (66) by means of a respective toothed belt (43, 74).

8. The device according to claim 7, in which the guide pins (61) are comprised of one of stainless steel or ceramic.

9. The device according to claim 7, in which the filling wheels (20) cooperate with one of a plastic or ceramic stripping body (26) for protruding filling material (1).

10. The device according to claim 6, in which the metering pistons (53) are comprised of one of stainless steel with a screen (54) or of air-permeable ceramic.

11. The device according to claim 10, in which the filling wheels (20) cooperate with one of a plastic or ceramic stripping body (26) for protruding filling material (1).

12. The device according to claim 6, in which the filling wheels (20) cooperate with one of a plastic or ceramic stripping body (26) for protruding filling material (1).

13. The device according to claim 1, in which the metering pistons (53) are comprised of one of stainless steel with a screen (54) or of air-permeable ceramic.

14. The device according to claim 1, in which the guide pins (61) are comprised of one of stainless steel or ceramic.

15. The device according to claim 14, in which the filling wheels (20) cooperate with one of a plastic or ceramic stripping body (26) for protruding filling material (1).

16. The device according to claim 1, in which the filling wheels (20) cooperate with one of a plastic or ceramic stripping body (26) for protruding filling material (1).

* * * * *